US006261439B1

(12) United States Patent
Schwabe et al.

(10) Patent No.: US 6,261,439 B1
(45) Date of Patent: Jul. 17, 2001

(54) CATHODIC PROTECTION SYSTEM FOR MITIGATING STRAY ELECTRIC CURRENT EFFECTS

(76) Inventors: Robert J. Schwabe, 8 Tony's Rd., Katonah, NY (US) 10536; Alexey V. Poliakov, Punavourenkatu 23, F139, Helsinki (FI), 00150; Earle C. Bascom, III, 4037 Ryan Pl., Schenectady, NY (US) 12303; Oleg Zuev, Lenskaya St., 19-2-227., St. Petersburg (RU), 195298; Igor Chernienko, Proveschcenia Str., 75-374, St. Petersburg (RU), 195297; Yuri Ya. Iossel, deceased, late of Helsinki (FI); by Boris Iossel, executor, 63 Topaz Way, San Francisco, CA (US) 94131; John F. Troisi, 149 Old Pascack Rd., Pearl River, NY (US) 10965; Shalom Zelingher, 164 Huntley Dr., Hartsdale, NY (US) 10530; Vladimir Fedorov, Rudnev Str., 28-1-229, St. Petersburg (RU), 194352; Vladimir Leonov, Rorolev Str, 27-1-288, St. Petersburg (RU), 197039

( * ) Notice: Subject to any disclaimer, the term of this patent is extended or adjusted under 35 U.S.C. 154(b) by 0 days.

(21) Appl. No.: 09/430,006

(22) Filed: Oct. 29, 1999

Related U.S. Application Data

(60) Provisional application No. 60/106,406, filed on Oct. 30, 1998, and provisional application No. 60/106,394, filed on Oct. 30, 1998.

(51) Int. Cl.[7] ..... C23F 13/00

(52) U.S. Cl. ..... 205/725; 205/730; 205/733; 205/740; 204/196.01; 204/196.06; 204/196.11; 204/196.12; 204/196.15; 204/196.16; 204/196.24; 204/196.26; 324/71.2; 324/263

(58) Field of Search ..... 204/196.02, 196.06, 204/196.11, 196.12, 196.15, 196.16, 196.24, 196.26; 205/725, 730, 733, 740; 324/71.2, 263

(56) References Cited

U.S. PATENT DOCUMENTS

| | | | | |
|---|---|---|---|---|
| 4,689,127 | * | 8/1987 | McAlister | 205/725 |
| 5,087,873 | * | 2/1992 | Murphy et al. | 324/71.2 |
| 5,126,654 | * | 6/1992 | Murphy et al. | 324/71.2 |
| 5,739,424 | * | 4/1998 | Beavers | 204/196.37 |

* cited by examiner

*Primary Examiner*—Bruce F. Bell
(74) *Attorney, Agent, or Firm*—William J. Sapone; Nims Howes Collison Hansen & Lackert

(57) ABSTRACT

A cathodic protection system utilizes dynamic control of an output from a power supply to vary an impressed current applied to a structure to be protected proportional to a measurement of stray electrical current. The current is also supplied to an anode bed in an amount sufficient to maintain the structure more negatively charged than the anode bed such that the stray electrical currents are directed away from the structure, thus avoiding electrolytic attack.

13 Claims, 11 Drawing Sheets

CATHODIC PROTECTION SYSTEM FOR MITIGATING STRAY ELECTRIC CURRENT EFFECTS

CROSS REFERENCE TO RELATED APPLICATIONS

This application claims priority in U.S. Provisional Patent Application Ser. No. 60/106,406, filed Oct. 30, 1998, and U.S. Provisional Patent Application Ser. No. 60/106,394 filed Oct. 30, 1998.

TECHNICAL FIELD

This invention relates to systems for protecting structures from galvanic and electrolytic corrosion and more particularly to a system for protecting structures such as underwater cable from electrolytic corrosion caused by stray electrical currents.

BACKGROUND

Cathodic protection systems are known. These systems provide protection by utilizing either sacrificial anodes in electrical contact with a metal to be protected, or non-sacrificial anodes connected to the metal with a direct current applied to the metal and anode, to neutralize the damaging galvanic effects.

Cathodic protection systems are used for buried metal structures as well as underwater structures. A particular area of concern is underwater power cables. These cables are typically laid upon or buried beneath the sea bed and are exposed to seawater which is an aggressive medium that can cause corrosion damage and limit cable life.

To resist the corrosion effects caused by exposure to seawater, such cables are typically insulated with a plastic jacket, most commonly made of polyethylene. In addition, such cables may carry internally, steel armor wires to protect from physical damage.

Referring to FIG. 1, a cross section of a typical power cable is shown. This has an oil duct 1, a copper conductor 2, a conductor screen 3, an insulation layer 4, an insulation screen 5, a lead sheet 6, a multiply polymer tape 7, a copper return conductor 8, a second polymer tape 9, a second copper return conductor 10, a polymer jacket 11, a layer of polypropylene yam 12, galvanized steel and zinc armor 13 and a polypropylene yarn covering 14.

In the design of such cables, it was expected that the zinc component of the armor cable would act as a sacrificial anode to provide cathodic protection from galvanic corrosion. The particular concern was corrosive effects on the steel cable. However, it was discovered that rather than galvanic corrosion of the protective steel armor, there is a significant, previously unknown, corrosive effect that could impact cable life.

It was discovered that corrosion protection needs to be considered not only to protect the metal in the cable, but in addition to protect the plastic protective jacket. Such jackets are typically produced of polyethylene, and usually doped with conductive material such as carbon. When subjected to electrolytic currents, these conductive materials leach out and/or dissolve from the protective jacket, leaving voids that fill with seawater. If allowed to continue, seawater could penetrate the jacket and begin an attack on the copper conductors. This type of corrosive penetration is illustrated in FIG. 2.

Once identified as a potential path for shortening cable life, attention turned to the conditions under which this would occur. It was determined that such corrosion would occur in areas where current caused by electrolytic effects leaves the structure, in an area known as the anode zone. As illustrated in FIG. 3, an underwater cable 1 will pass electrolytic currents in a way which establishes a cathode zone at one end of the cable where it leaves the sea floor and an anode zone at the other end. Since the polarity of electrolytic current is important, AC currents do not generally cause electrolytic corrosion. Thus, the fact that it was a power cable was not a probable cause of such electrolytic corrosion. Upon further investigation it was discovered that stray DC currents from various sources which travel through the earth and water, enter the cable to seek a path to ground. Such stray currents may arise from the passage of electric trains in an area near where the cable is located, from welding operations, from geomagnetic induced currents as a result of tide action, and even from other cathodic protection systems which utilize DC current to protect other structures. Such stray electric currents are quite variable over time, and thus, a cathodic protective system which utilizes a fixed current, as is typically used in conventional cathodic protection systems, would not protect against these variable electrolytic effects as there is no capability for adapting to the variation in current density.

Existing technology for detecting and measuring electrical currents under water is to use a pair of reference electrodes spaced at some distance and then to measure the voltage potential between these electrodes. This approach requires that very stable reference electrodes be used. A reference electrode with good stability is characterized by having a relatively constant voltage over the expected operating range of current density to be detected. A problem with reference electrodes in general is that they all have a self potential shift depending on the type of reference electrode used. The magnitude of this potential shift is on the order of several milli-volts. The potential shift limits sensitivity of the reference electrode system because it is impossible to detect a voltage potential between a pair of electrodes less than the potential shift of the electrodes. For the purposes of controlling cathodic protection systems, this limitation can present a problem. In principal, a technique to remove the potential shift of the electrodes would involve revolving electrodes in the water in the plane parallel to the electric field being measured. Practically, this is difficult to do in water while maintaining sufficient electrode spacing to provide good sensitivity.

SUMMARY OF THE INVENTION

It is an object of the present invention to provide a cathodic protection system that protects structures from electrolytic corrosion.

It is a further object of the present invention to provide means for measuring stray electrical currents and means for counterbalancing in real time the stray electrical currents to prevent electrolytic corrosion damage.

It is a further object to provide a cathodic protection system which prevents degradation of insulated and polymer protective materials on underwater or buried structures.

These and other objects of the present invention are achieved by a cathodic protection system comprising means for measuring stray electrical currents adjacent a structure to be protected, non-sacrificial anode means located adjacent to the structure, direct current power supply means having a negative terminal connected to the structure and a positive terminal connected to the anode means, and, control means for receiving a signal from the means for measuring and for varying the output from the power supply such that the structure has a controlled charge which renders the structure more negative than the anode means.

By direct monitoring of the stray currents and adjusting the structure so that it remains more negatively charged than the anode means, the stray electrical currents avoid the structure and are directed to the adjacent anode means, thus prevent electrolytic corrosion. Preferably, a reference electrode is provided and located near the structure, with a signal sent to the control means as a control signal, so that the potential difference between the means for measurement and a measurement point on the structure can be determined. Preferably, the means for measurement is a current density sensor which supplies a signal to confirm that the structure remains sufficiently more negative than the anode means for preventing electrolytic corrosion.

DETAILED DESCRIPTION OF THE INVENTION

There are three main features of the invention. The system provides protection of either metallic or non-metallic conductive elements or submarine structures or equipment such as submarine power cables from damage caused by the influence of external stray currents and aggressive sea media. This provides cathodic protection of metallic elements submersed in sea water from both electrolytic and galvanic corrosion, and protection of non-metallic elements from electrolytic dissolution of conductive particles in the elements e.g., polyethylene doped with carbon or graphite as may be found in the jacket of a submarine power cable or as insulation protection for other structures.

The system automatically maintains the necessary protection regime with any current density level, and direction of external stray current. An additional advantage is that the system can operate successfully without having a drainage point located in the water. Instead, the drainage point can be located on land at one end of the protected structure or equipment. Further, the system can successfully operate with a reference electrode located away from the drainage point.

Figure 4A:
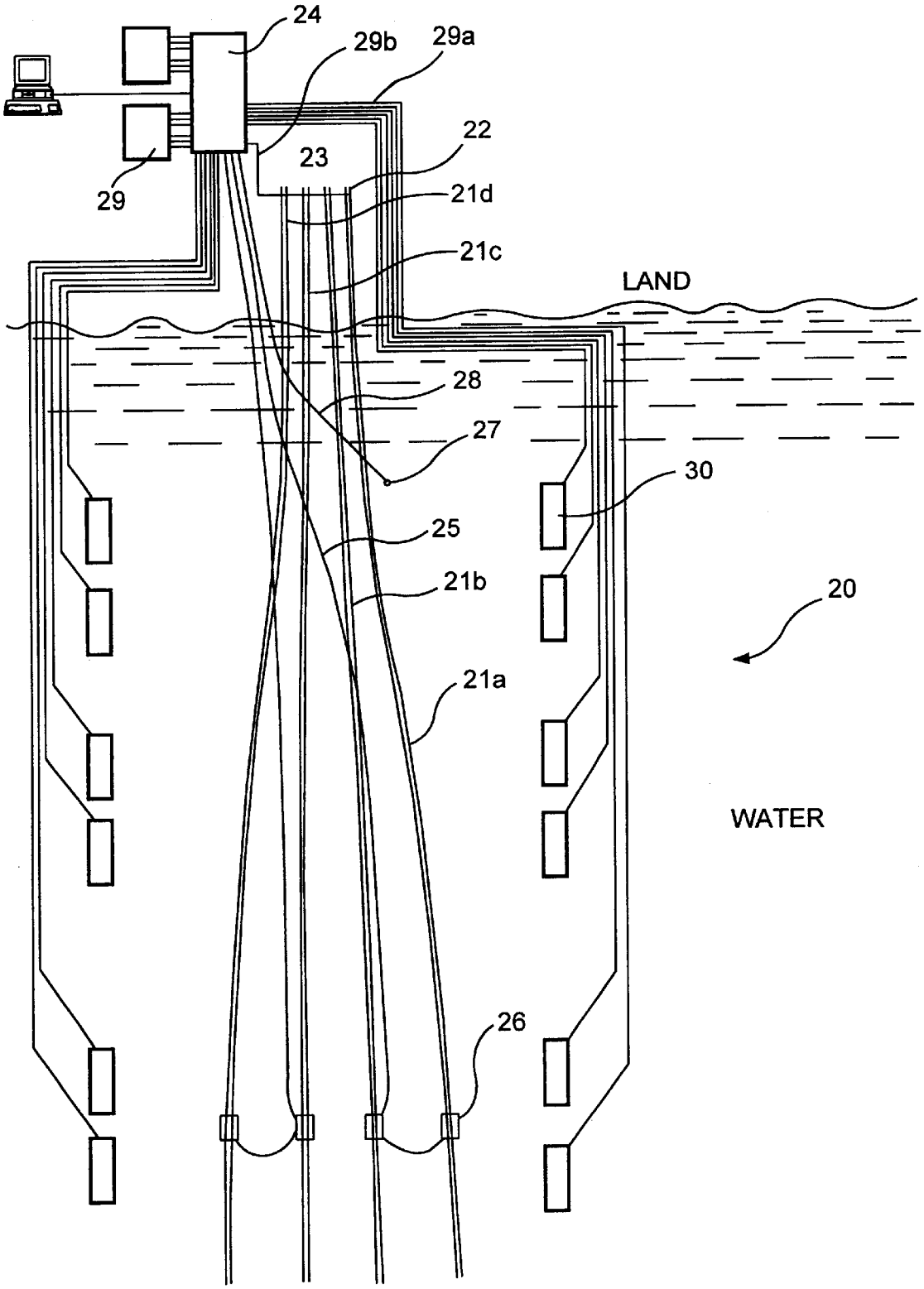
FIG. 4*a* is an illustration of the cathodic protection system according to the present invention.

Referring to FIG. 4*a*, a cathodic protection system 20 is shown, by example, with reference to the protection of four underwater power cables 21*a*, 21*b*, 21*c* and 21*d*. While a system for protecting power cables is shown, the invention is not so limited and it may be applied to virtually any structure subject to electrolytic corrosion, particularly those having protective jackets subject to doping losses.

For ease in illustration, the system as applied to a single cable will be described, it being understood that all four cables are similarly protected.

The cable 21*a* has a first end 22 terminating at a station 23, which is normally on land. In that station is located a measuring and control unit 24. This measuring and control unit receives a control signal 25 from a reference electrode 26. A current density sensor 27, located underwater near the station 23, provides a current density signal 28 to the measuring and control unit. The measuring and control unit is connected to a DC power supply 29 that is connected from its positive terminal 29*a* to a plurality of anode beds 30, and at its negative terminal 29*b* to the cable 21*a*.

Figure 1:
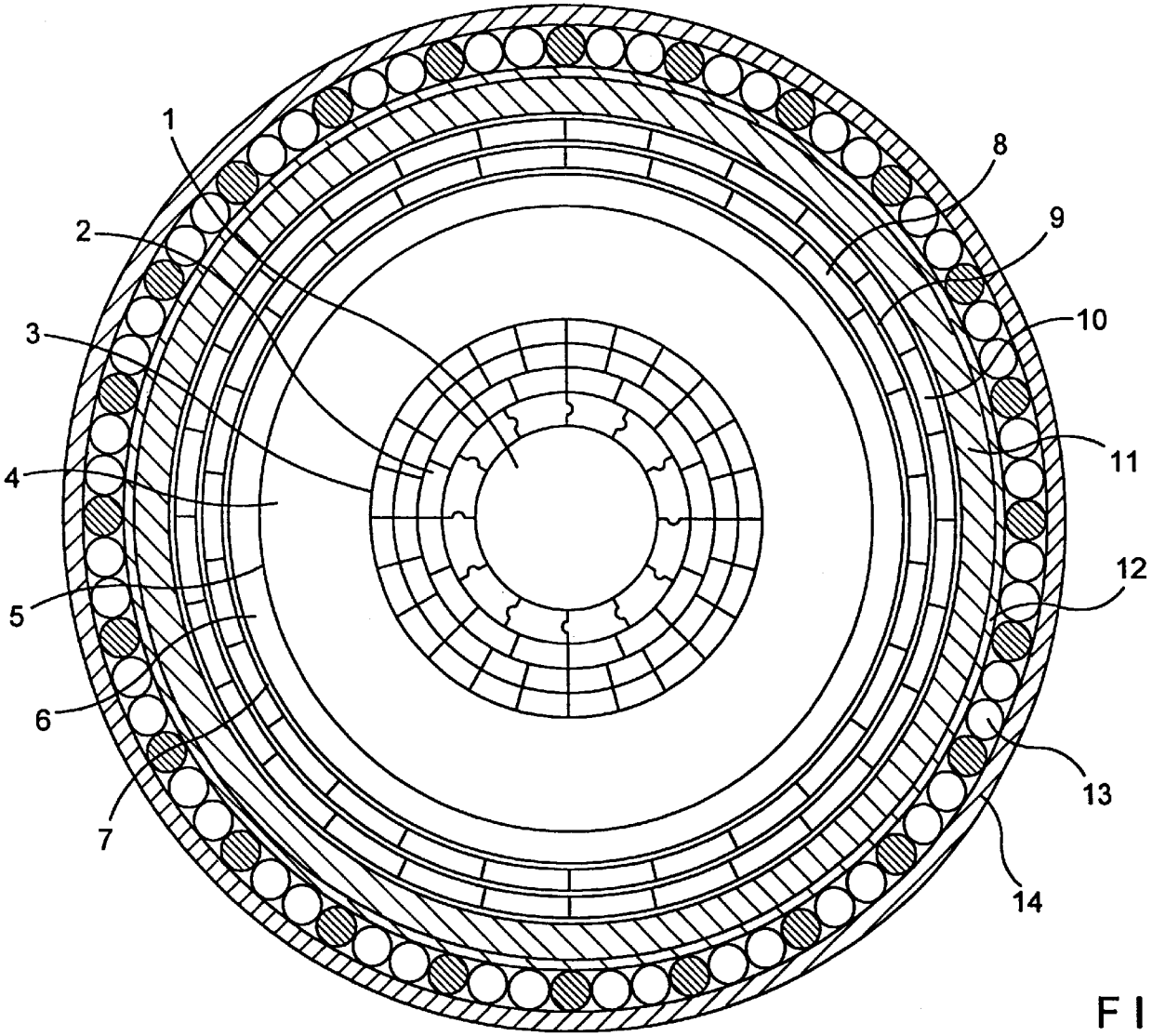
FIG. 1 is a cross-sectional view of an underwater cable.
Figure 2:
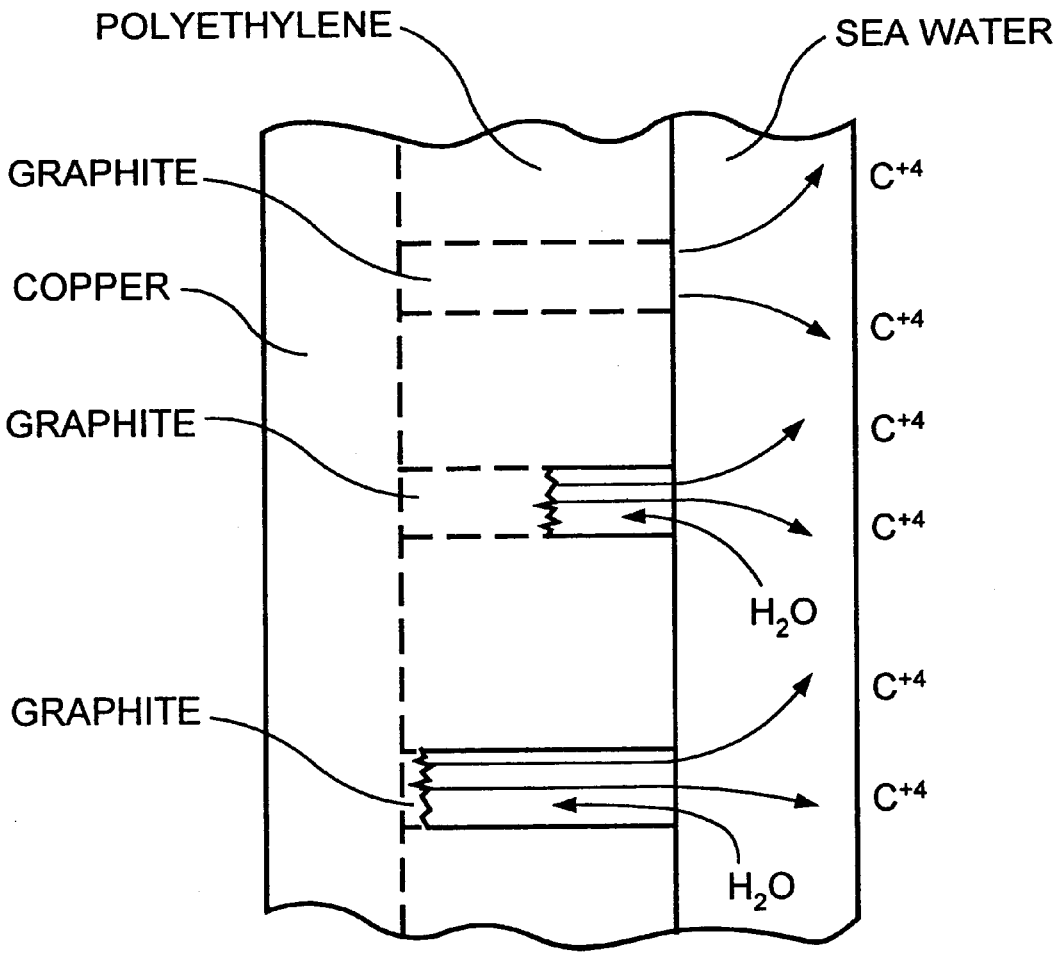
FIG. 2 is an illustrative view of the effects of electrolytic corrosion on an underwater cable jacket.
Figure 3:
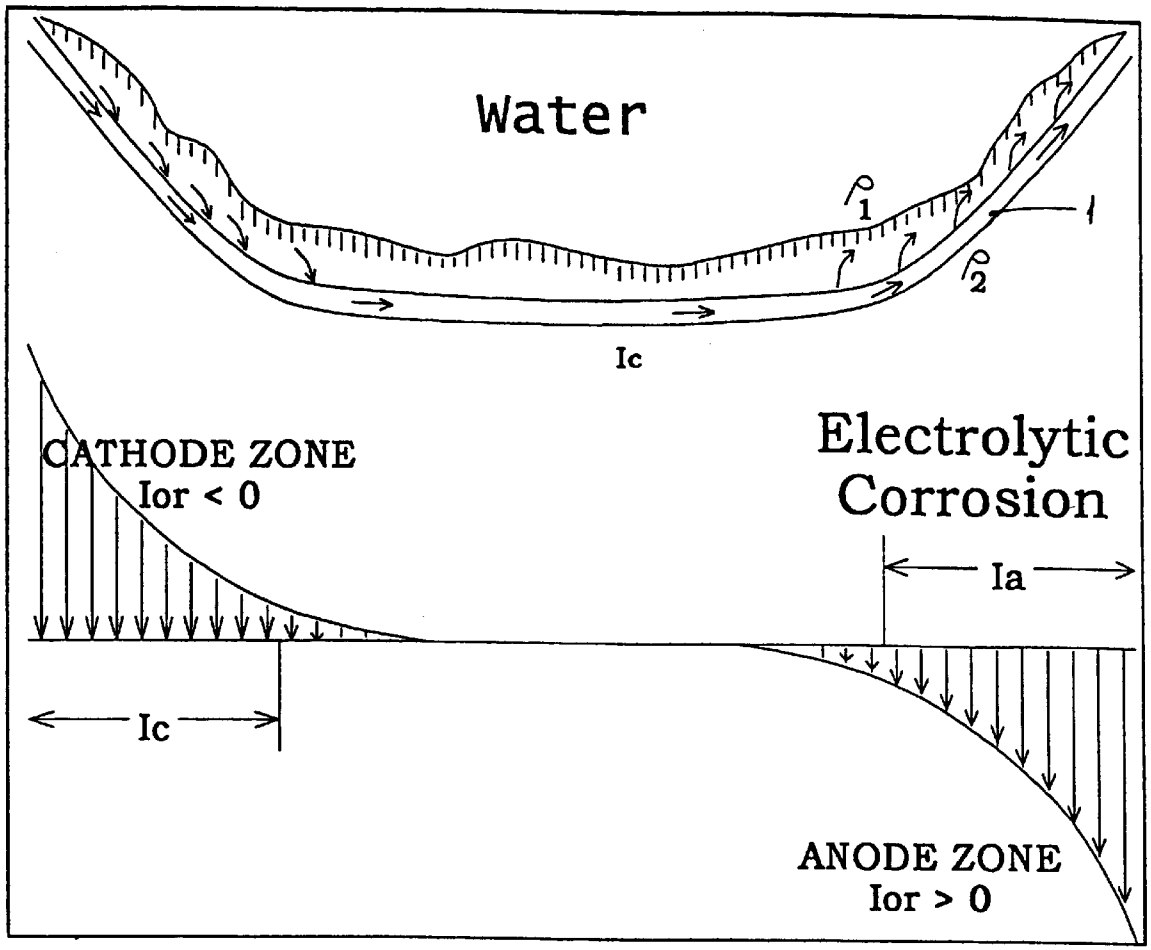
FIG. 3 is a graph illustrating current distribution along an underwater cable.

Preferably the anode beds are disposed along the cathode zone illustrated in FIG. 2, though they can be located in other areas as well.

In operation, the measuring and control unit monitors the signal from the current density sensor and from the reference electrode in real time, then directing the power supply to increase or decrease the power flowing to the anode beds to render the cable 21*a* relatively more negative than the anode beds, thus the stray currents preferably enter the anode bed instead of the cable 21*a*, optimally protecting the cable.

Figure 4B:
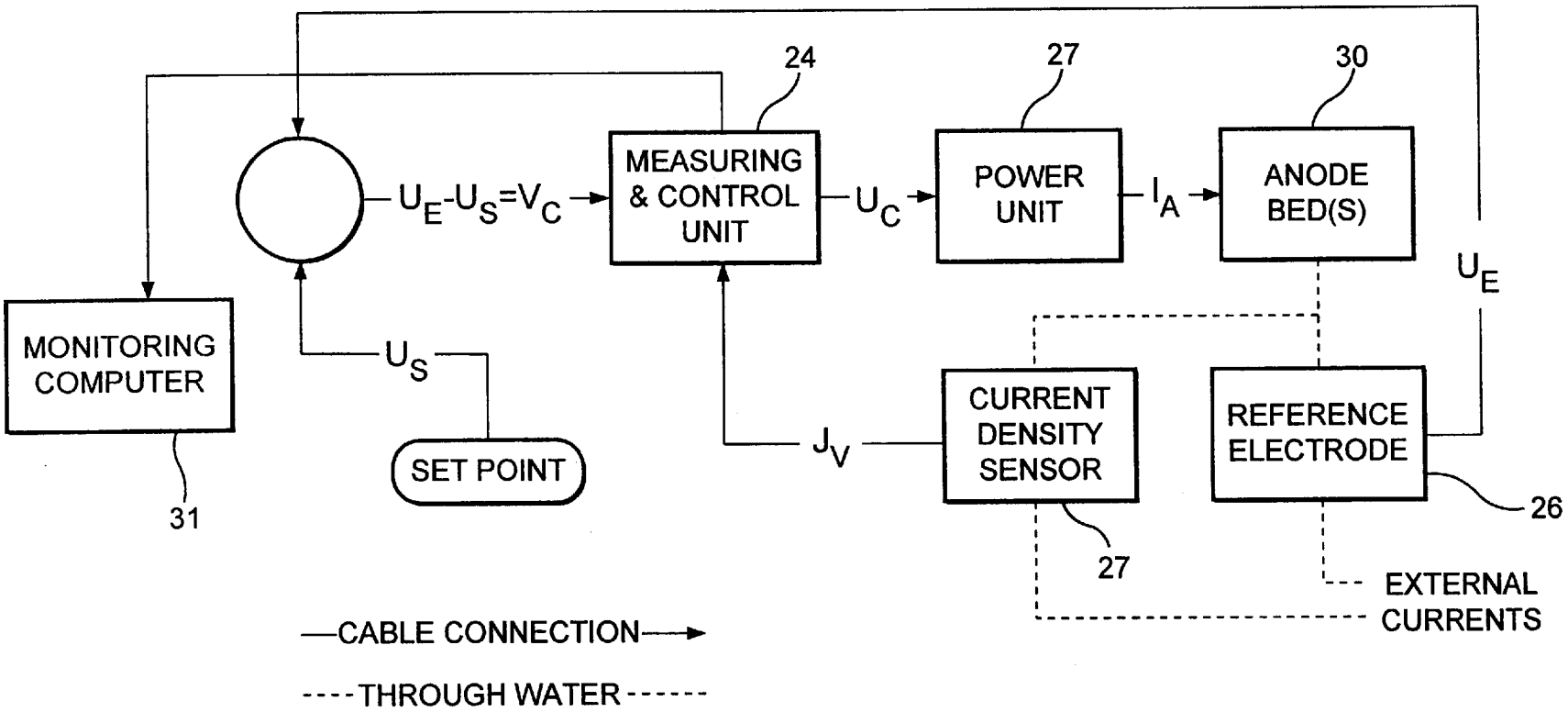
FIG. 4*b* is a block diagram representation of the inventive system.

Referring to FIG. 4*b*, the system is shown in block diagram form, showing the anode beds 30, reference electrodes 26, power units 29, measurement/control units 24, current density sensor 27, and a monitoring computer 31.

The system operates in the following manner:

The potential of reference electrode $U_E$ is compared with a pre-assigned (set value) value, $U_S$. The difference of these values $\Delta U = U_{Reference\ Electrode} - U_{Set\ Point} = V_C$ is an input signal for the measuring/control unit. The output signal of the measuring/control unit is proportional to the value of $\Delta U$, so $U_C = Q_{Measuring/Control\ Unit} \Delta U_C$. Q represents the transfer coefficient (multiplier) in the relationship.

The output current from the power unit flowing through the water from an anode bed is directly proportional to $U_C$, as follows:

$I_{Anode\ Bed} = Q_{\ Power\ Unit}\ U_C$, also at the input of the measuring/control unit.

$I_{Anode\ Bed} Q \Delta U_C$ and $Q -_{Measuring/Control\ Unit}\ Q_{Power\ Unit}$ Under the influence of this current, the potential of the reference electrode would change from some initial value $U_{INITIAL}$ to value $U_{Electrode}$. This increase of potential $\Delta U_{Electrode}\ U_{INITIAL}$ will cause a corresponding change in the anode bed current. The process will stop, when the following equation is fulfilled:

$$I_{Anode\ Bed} = Q_{optimal}(U_{REFERENCE\ ELECTRODE} - U_{SET})$$

where the value $Q_{Optimal}$ is established experimentally during the process of tuning and calibrating the system. The optimal regime for the system to operate is determined with the help of the current density sensor. The value of the transfer coefficient, Q, is considered optimal if the measured value from the current density sensor is lower than the pre-assigned value. In cases where there is a deviation in the optimal operating regime for the system, pre-assigned values of $U_{SET}$ and Q need to be periodically refined during normal system maintenance.

Several advantages of the system are as follows:

1. There is no need for direct contact in the vicinity of the reference electrode with the protected structure to obtain the necessary information regarding the influence of the stray electrical currents, because the system measures the potential difference $V_C$ between the point of drainage (on one end of the equipment or structure, e.g., cable) and the location of the reference electrode. With the appropriate choice of reference electrode location, the measured value is determined, mainly, by the lengthwise fall of the voltage on the protected structure (i.e., along the cable). This voltage is created by both stray electrical currents and currents from the protection system. Because the currents inside the protected structure are flowing in the same direction as the stray electrical currents, voltages created by them are additive.

Figure 5:
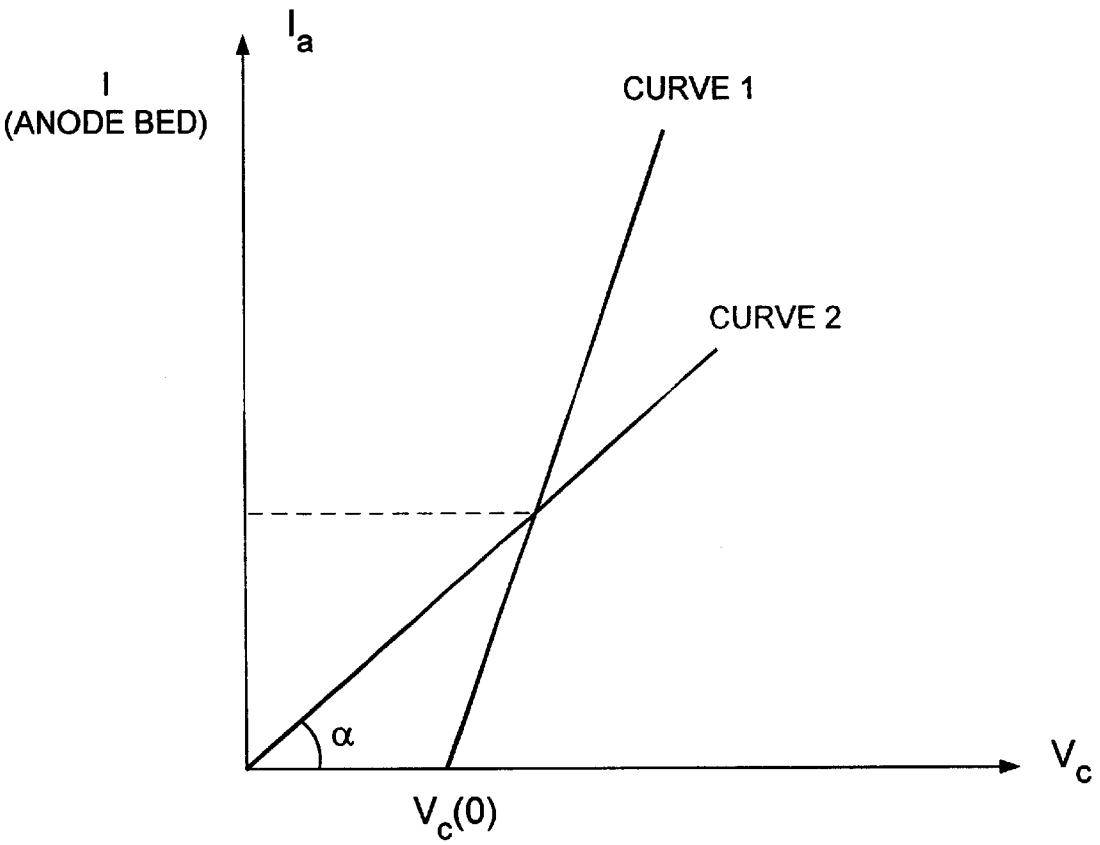
FIG. 5 is a graph illustrating the voltage current relationship utilizing the present invention.

FIG. 5 illustrates the following relationship. With an increase of the system current from zero (0) to some value, the voltage $V_C$ also increases (see Curve 1). Here, the "zero" value of the protective current corresponds to the voltage drop $V_C(0)$, produced by external currents only (no anode bed currents). In accordance with the system's operating principles, the impressed current from the power units via the anode bed(s) is proportional to the input signal $V_C$ (See Curve 2). The angle of inclination of this line a is determined by the value of the transfer coefficient, Q, of the equipment. The relationship between Q and $\alpha$ is shown in the following equation.

$$\alpha = \mathrm{Tan}^{-1}(Q)$$

The protection system with feedback reaches equilibrium and optimal performance at an output current equal to the ordinate (anode bed output current) where curves 1 and 2 intersect. This ordinate depends on the transfer coefficient of the system and the level (magnitude) of stray currents thereby determining the value of $V_c(0)$. This point is characterized by the fact that the optimal value of the transfer coefficient, Q, the current density at all points on the protected structure is decreased at the same time, regardless of the level of stray currents.

Figure 6:
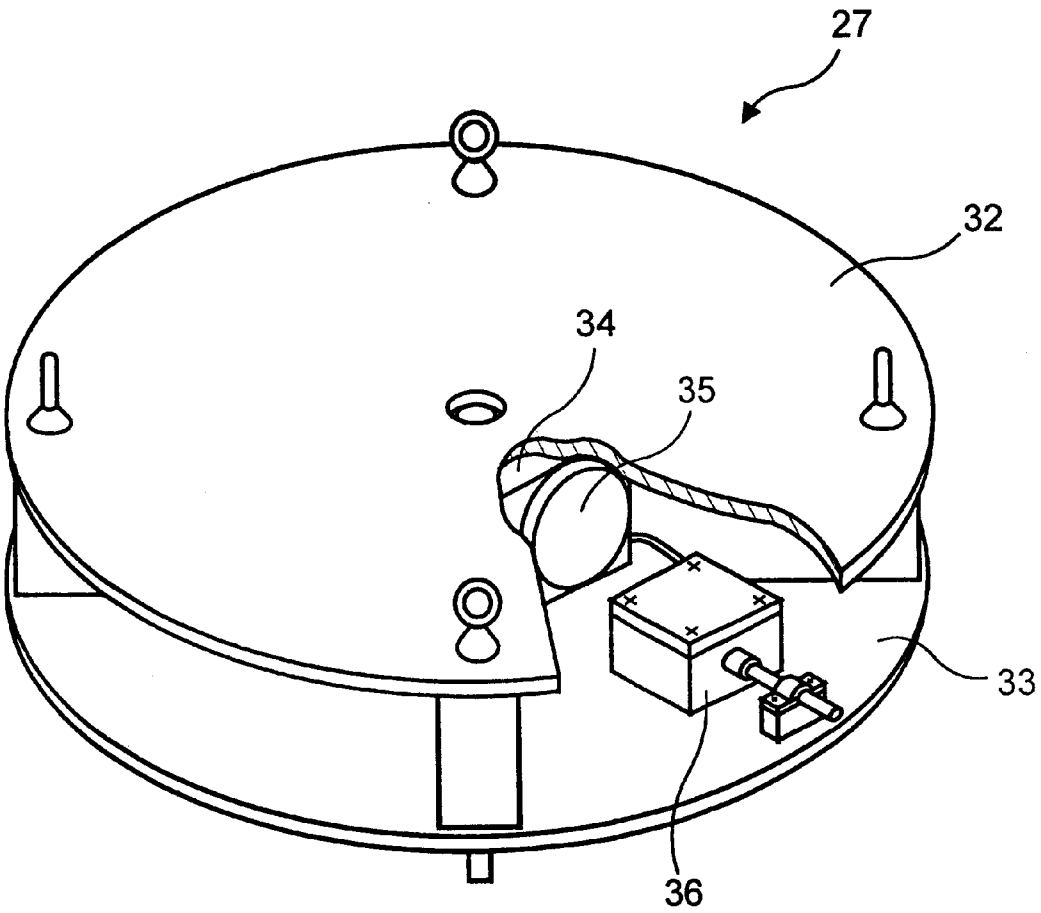
FIG. 6 is a view of a current density sensor usable with the present invention.
Figure 7:
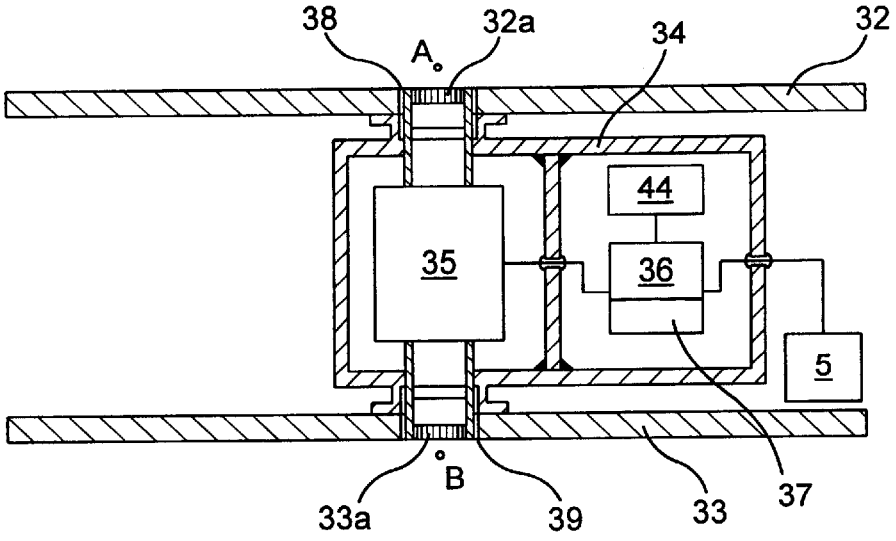
FIG. 7 is a cross sectional schematic view of the current density sensor shown in FIG. 6.

An important component of the inventive system is the current density sensor. Referring to FIGS. 6 and 7, the current density sensor 27 has a pair of non-conductive disks 32 and 33 which sandwich a container 34 therebetween. The container 34 houses an electrode unit 35 connected to a control unit 36. An internal battery 37 may be included, though the sensor normally utilizes power from an external, remotely located source (not shown). Openings 38 and 39 are provided in the disks 32 and 33, each opening receiving a respective perforated cap 32*a* and 33*a* to allow access of the seawater to the electrode unit.

Figure 8:
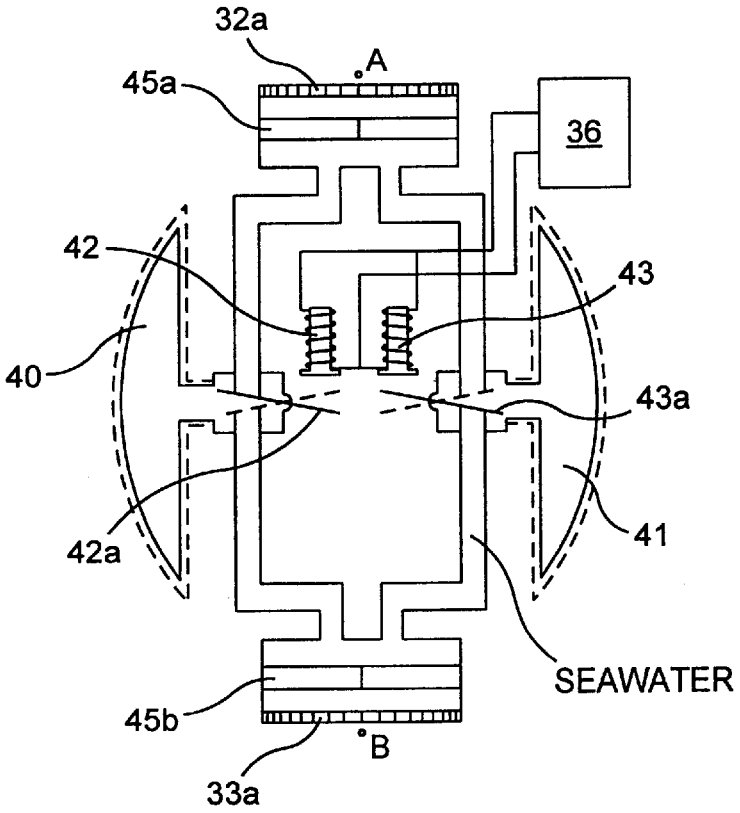
FIG. 8 is a view of an electrode unit used in the current density sensor.

Referring to FIG. 8, a diagram of the electrode unit 36 is shown. The unit 36 has pair of copper electrodes 40 and 41 which are alternatively connected to points A and B via a pair of switch elements 42 and 43 which may comprise solenoids. Seawater enters the units through the perforated caps and is alternatively fed by valves 42*a* and 43*a* to the electrodes, the valves actuated by the solenoids. Thus, the potential difference is measured between points A and B in the seawater by alternatively connecting the electrodes 40 and 41 to seawater from points A and B for from about 5 to 10 seconds per cycle. This exposes the sensor to the stray electric current field generating an output signal from the electrodes which varies with the frequency of the alternating exposure time. This output signal is amplified and returned to the measurement and control unit. Plastic screens 45*a* and 45*b* are also used as will be described below.

The current density sensor uses a unique orientation of reference electrodes and mechanical valves to commutate the electric current field potential. This approach eliminates the need for special reference electrodes with a minimal potential shift, avoids the need to separate the electrodes by a large distance to maintain high sensitivity, and avoids a system where electrodes would have to be physically moved through the water.

Figure 11:
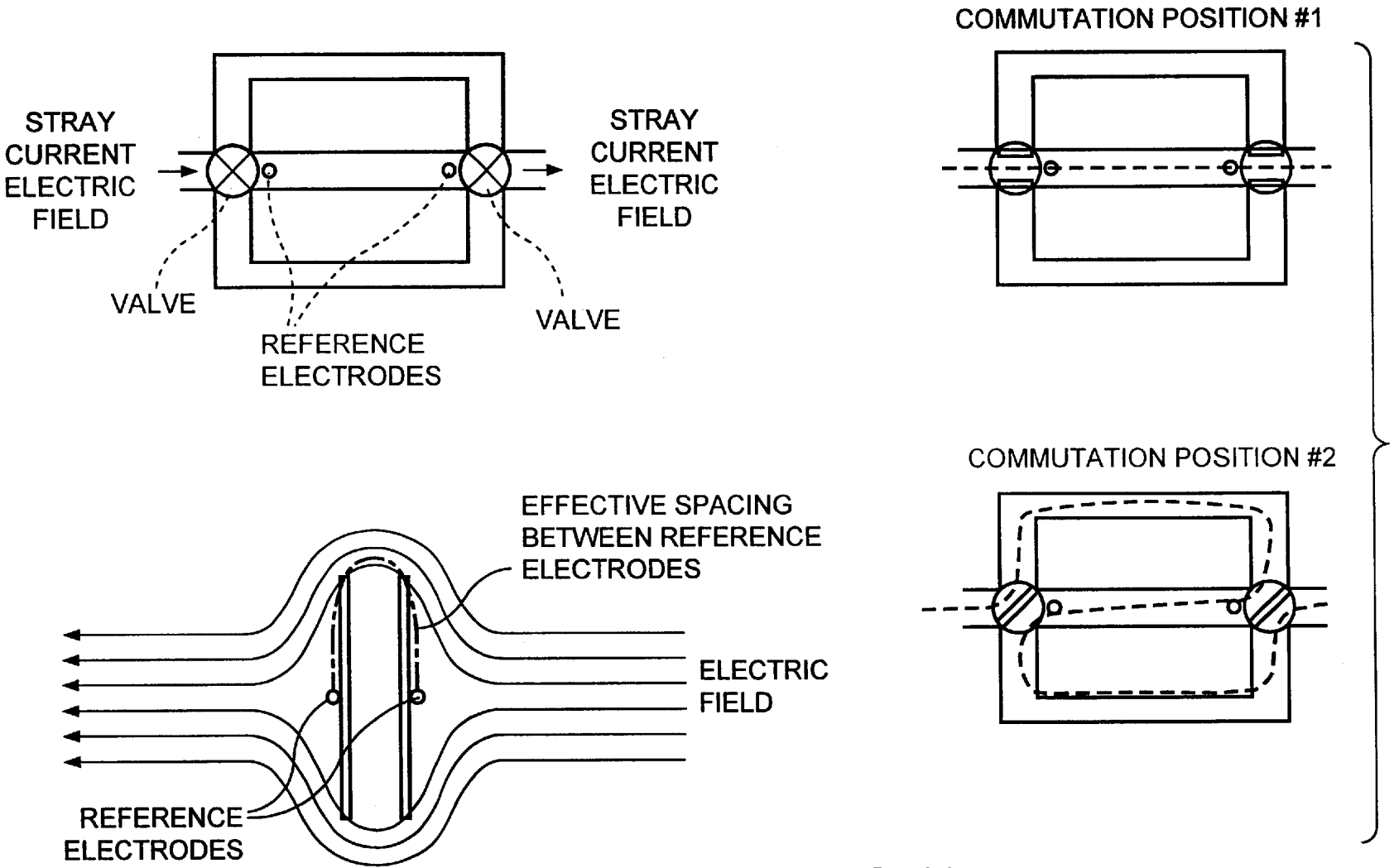
FIG. 11 is a schematic showing operation of the current density sensor.

The sensor makes use the plastic (e.g., polyethylene) "screens" to effectively increase the separation of reference electrodes without the disadvantage of increased physical spacing between the electrodes. The screens work because they are of a much higher electrical resistivity than water and consequentially divert the current fields around the sensor rather than allowing the fields to pass through the sensor. With electrodes on either side of the sensor, the effective spacing of the electrodes is approximately 2 m while the physical spacing of the electrodes is only 0.35 m. Consequently, the height of the sensor can be greatly reduced. FIG. 11 shows the basic principal for operation of the screens.

The valve system is used in the sensor to commutate the electric field that reaches the reference electrodes. This commutation converts the stray current electric field to an alternating current (AC) signal, while the self-potential of the reference electrodes remains a DC signal. Once this is achieved, conventional techniques (i.e., applying a capacitor across the output of the reference electrodes) can be used to filter the DC signal and measure only the stray current electric field. The valves allow for a stray current electric field to pass the electrodes in both directions.

The valve system also provides an additional feature. By removing the self-potential of the electrodes, it is not necessary to use stable reference electrodes (e.g., silver-silver-chloride). Instead, simple metal electrodes can be used which are cheaper and are not subject to an accumulation of ions that can deteriorate the electrodes' performance with time. Thus, copper electrodes may be used.

Also, no moving parts are required to achieve commutation in the water (e.g., do not need a rotating system of reference electrodes.)

The current density sensor optionally includes a three component magnetometer 44 which determines the spatial orientation of the sensor when remotely located as for example on an uneven seabed. A measurement $H_0(1)$ is taken before installation when the sensor is horizontal. After installation, a second measurement $H_0(2)$ is taken and the angle of deviation vertically from the normal plane of the sensor is determined.

From testing, it was determined that stray electrical currents exceeding abut 0.15 $A/m^2$ could cause damage to the cable, and that stray currents could exceed 0.3 $A/m^2$, particularly near the termination stations at each end of the cable and most particularly at the end of the anode zone.

The measurement and control unit, utilizing real time information from the reference electrode and current density sensor inpresses, in real time, a controlled counterbalancing protective current to reduce the effect of stray currents on the structure to a level at or below 0.15 $A/m^2$. This control unit is preferably a microprocessor based controller that is accessible by a monitoring computer via direct link, LAN or modem connection. The monitoring computer, which can be a standard notebook or desktop PC, can monitor and log the signal inputs, power output, and other operating parameters and thereby confirm satisfactory operation of the system.

By utilizing a dynamic protective system, the amount of power necessary for protecting the cable is optimized to reduce costs, yet at the same time provides a range sufficient to counteract even high peak stray electrical currents which could potentially, even by their intermittent action, cause damage to the protective jacket.

Figure 9:
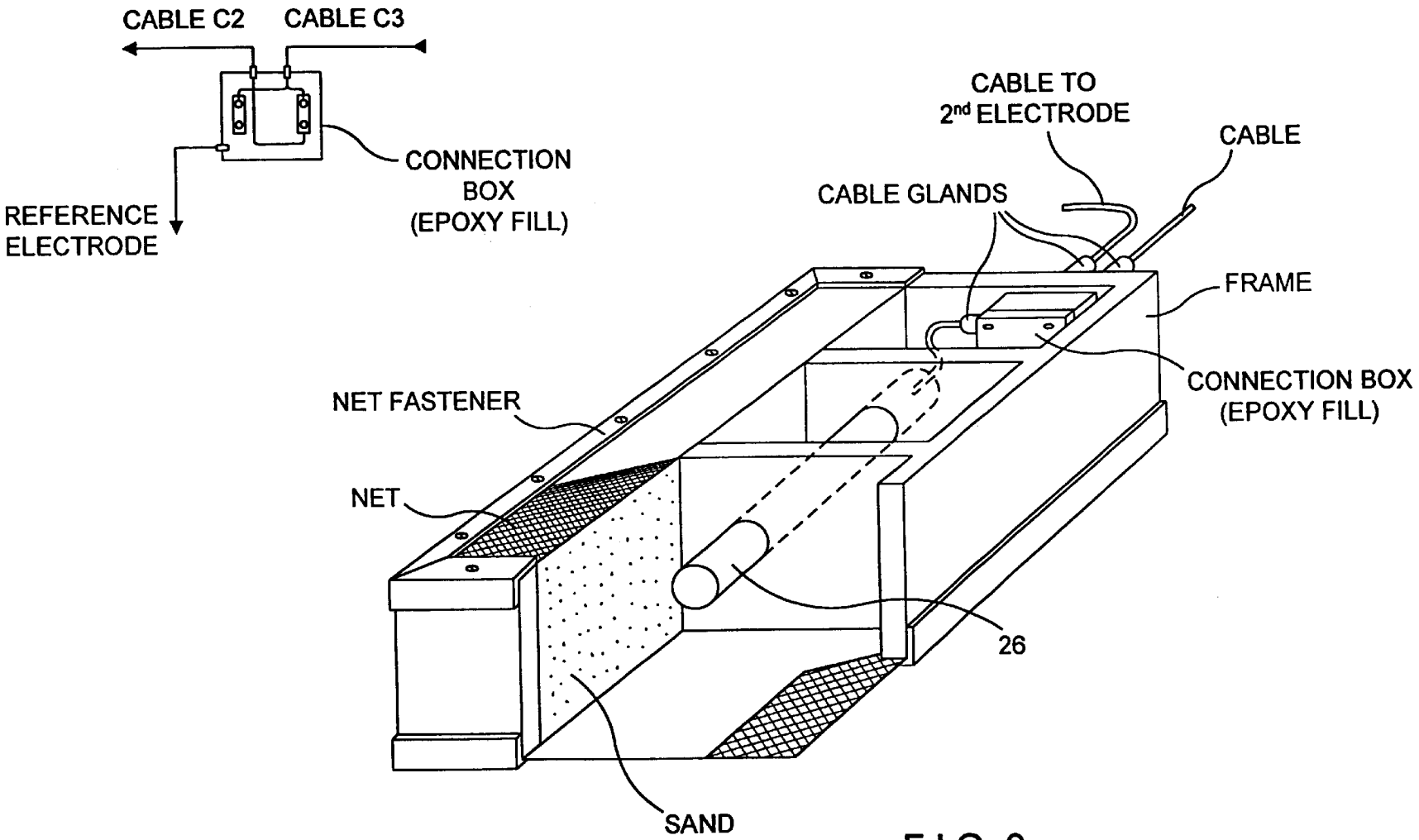
FIG. 9 is a cross sectional view of a reference electrode assembly.

The reference electrode 26, shown in FIG. 9, comprises a non-sacrificial electrode structure of high potential stability, preferably being a silver/silver chloride electrode. The electrode is housed in a casing 46 suitable for location on a seabed adjacent the cable. A signal wire 47 connects the electrode to the monitoring and control unit. Ballast 48 is included for underwater applications.

Figure 10:
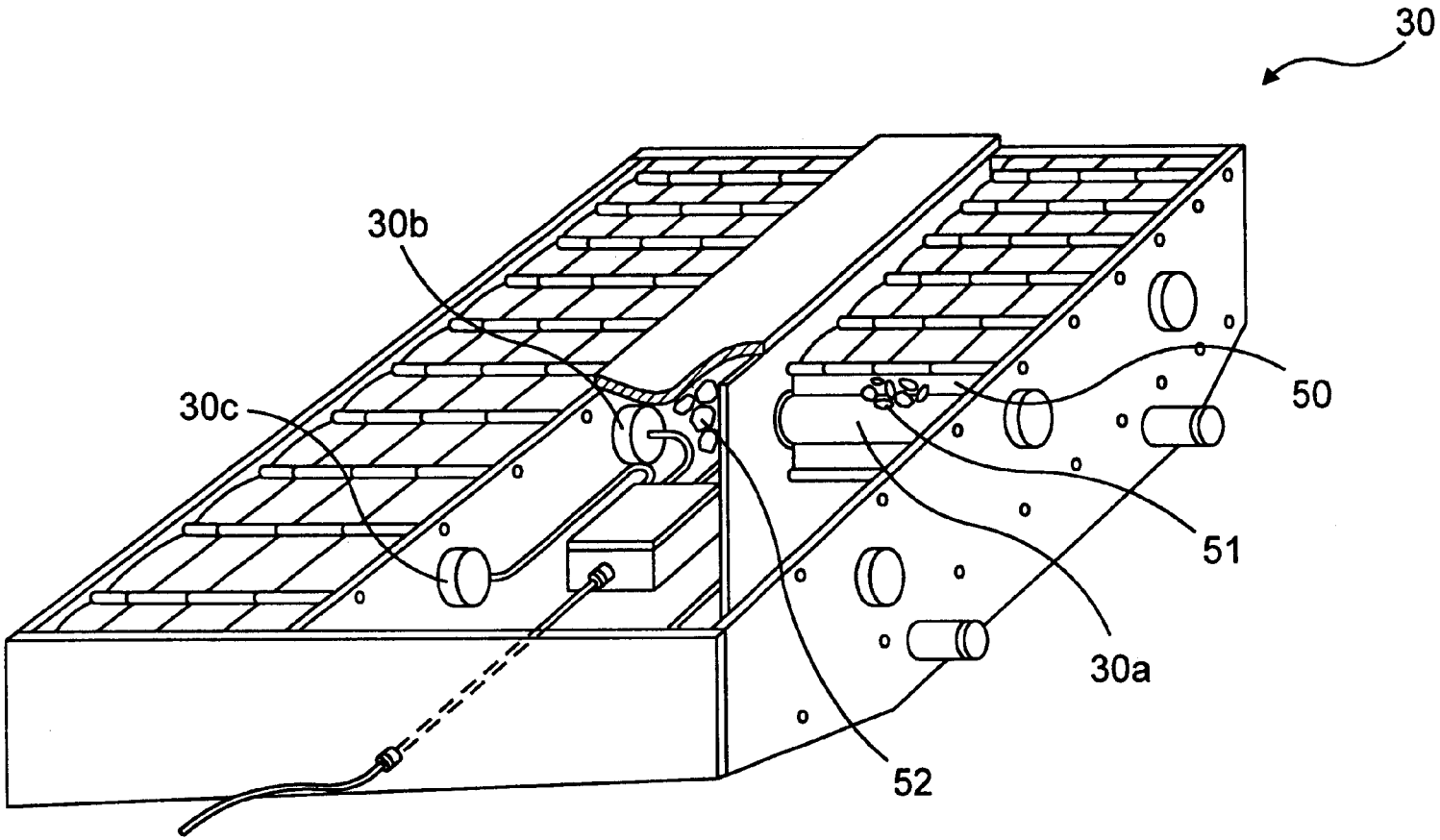
FIG. 10 is an illustration of an anode bed.

The anode bed 30 shown in FIG. 10, is composed of a casing 49 containing a plurality of non-sacrificial anodes 30*a*, 30*b*, etc., preferably composed of magnetite, each disposed in a segregated chamber 50 and surrounded by a semiconductive material 51. In one embodiment, the anodes are embedded in coke, which reduces anode bed resistance and optimizes anode performance. Ballast 52 is included for underwater applications.

Utilizing the present invention, structures having protective jackets can obtain enhanced protection, particularly from stray electrical currents which cause localized electrolytic corrosion from removal of conductive doping materials. By providing a system responsive to actual current conditions, excess stray currents are counterbalanced by increasing the power output to the anode bed, thereby avoiding corrosive damage.

While preferred embodiments of the present invention have been shown and described, it will be understood by those skilled in the art that various changes or modifications can be made without varying from the scope of the invention.

We claim:

1. A cathodic protection system for use on a structure composed of materials subject to galvanic and electrolyte corrosion comprising:

means for measuring stray electrical currents adjacent to the structure;

anode means located adjacent to the structure;

power supply means having a negative polarity terminal and a positive polarity terminal, the negative polarity terminal connected to the structure, the positive polarity terminal connected to the anode means; and control means for receiving a signal from the measuring means and for varying an output from the power supply means such that the structure has a controlled charge which renders the structure more negative than the anode means.

2. The system of claim 1 further comprising a reference electrode means located adjacent the structure for supplying a reference signal to the control means.

3. The system of claim 2 wherein the reference electrode is a silver/silver chloride electrode.

4. The system of claim 1 further comprising monitoring means for monitoring and logging the signals received by the control means and the output from the power supply means.

5. The system of claim 1 wherein the means for measuring is a current density sensor.

6. The system of claim 1 wherein the structure is an underwater cable.

7. The system of claim 1 wherein the materials are selected from the group consisting of metal and plastic containing conductive components therein.

8. The system of claim 1 wherein the control means varies the power supply output to substantially maintain a protective current on the structure at a level at or below about 0.15 $A/m^2$.

9. The system of claim 1 wherein the control means is a microprocessor.

10. A method for protecting structures composed of materials subject to galvanic and electrolytic corrosion comprising:

measuring stray electric currents in an area adjacent the structure;

providing anode means adjacent the structure;

variably impressing a current on the structure and anode means in response to the measurement of stray electrical current in an amount sufficient to counterbalance the stray electrical currents such that the structure is more negatively charged than the anode means.

11. A current density sensor for use in a cathodic protection system comprising:

a first electrode;

a second electrode spaced from the first electrode;

resistive separator means disposed between the first and second electrodes;

power supply means for powering the first and second electrodes; and switch means for alternating a connection of the power supply means to each electrode to measure alternatively a potential at the first and second electrodes to generate a potential difference output signal therefrom.

12. The current density sensor of claim 11 further comprising amplifier means to amplify the potential difference output signal.

13. The current density sensor of claim 11 further comprising a magnetometer for determining a spatial orientation of the first and second electrodes, and for generating a signal related thereto.

* * * * *